US008353579B2

(12) United States Patent
Hibino

(10) Patent No.: US 8,353,579 B2
(45) Date of Patent: Jan. 15, 2013

(54) DROPLET EJECTING HEAD CAPABLE OF SUPPRESSING WORSENING OF DEFORMATION EFFICIENCY OF ACTUATOR

(75) Inventor: Tomoko Hibino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 155 days.

(21) Appl. No.: 13/032,264

(22) Filed: Feb. 22, 2011

(65) Prior Publication Data

US 2011/0205314 A1 Aug. 25, 2011

(30) Foreign Application Priority Data

Feb. 19, 2010 (JP) ..... 2010-034993

(51) Int. Cl.
*B41J 2/045* (2006.01)

(52) U.S. Cl. ..... 347/71

(58) Field of Classification Search ..... None
See application file for complete search history.

(56) References Cited

U.S. PATENT DOCUMENTS 6,474,784 B1 11/2002 Fujii et al.
2001/0007460 A1 7/2001 Fujii et al.
2005/0200663 A1 * 9/2005 Hibi et al. ..... 347/68
2007/0176978 A1 8/2007 Sugahara

FOREIGN PATENT DOCUMENTS

JP 2000-168070 A 6/2000
JP 2006-167506 A 6/2006
JP 2007-203515 A 8/2007

* cited by examiner

*Primary Examiner* — Matthew Luu
*Assistant Examiner* — Lisa M Solomon
(74) *Attorney, Agent, or Firm* — Baker Botts L.L.P.

(57) ABSTRACT

A first piezoelectric layer is formed with independent electrodes separated from one another and arranged at positions corresponding to openings of pressure chambers. The first layer has independent active portions at positions where the independent electrodes are located. The independent active portions can displace selectively. A second piezoelectric layer is formed with individual electrodes connected by connection electrodes and arranged at positions corresponding to the openings. The second layer has individual active portions at positions where the individual electrodes are located. The individual active portions cannot displace selectively. Each opening has a shape that is longer in one direction than in another direction intersecting the one direction. Each individual electrode has a shape that is longer in the one direction than in the another direction. The connection electrodes connect one-direction ends of the individual electrodes with one another, the one-direction ends being ends in the one direction.

17 Claims, 9 Drawing Sheets

DROPLET EJECTING HEAD CAPABLE OF SUPPRESSING WORSENING OF DEFORMATION EFFICIENCY OF ACTUATOR

CROSS REFERENCE TO RELATED APPLICATIONS

This application claims priority from Japanese Patent Application No. 2010-034993 filed Feb. 19, 2010. The entire content of the priority application is incorporated herein by reference.

TECHNICAL FIELD

The invention relates to a droplet ejecting head that ejects liquid droplets from ejection ports.

BACKGROUND

In an inkjet head which is an example of a droplet ejecting head, flushing is known as technique for maintaining conditions of menisci formed in ejection ports. Flushing includes ejection flushing for ejecting ink droplets from the ejection ports by driving piezoelectric actuators (vibrators) and non-ejection flushing for vibrating menisci without ejecting ink droplets from the ejection ports by driving the piezoelectric actuators. Especially when ink with high viscosity and quick drying characteristics is used, an increase in viscosity of ink and hardening of ink tend to occur near the ejection ports. However, by performing ejection flushing and non-ejection flushing, it is possible to maintain conditions of menisci and to well maintain recording quality.

The piezoelectric actuators are arranged in confrontation with openings of pressure chambers (cavities), and have piezoelectric layers (piezoelectric elements) sandwiched between electrodes with respect to the thickness direction. The pressure chamber is a space that is provided for each ejection port and that is in communication with the ejection port. The pressure chamber is exposed, through an opening, in a surface of a channel member in which ink channels are formed. Driving of the piezoelectric actuator causes an active portion of the piezoelectric layer (a portion of the piezoelectric layer sandwiched between the electrodes in the thickness direction) to be displaced so that energy is applied to ink within the pressure chamber. This causes an ink droplet to be ejected from the ejection port, or causes a meniscus to be vibrated without ejecting an ink droplet from the ejection port.

SUMMARY

According to one aspect, the invention provides a liquid ejecting head including a channel member and an actuator. The channel member is formed with a liquid channel having a plurality of ejection ports for ejecting droplets and a plurality of pressure chambers in fluid communication with respective ones of the plurality of ejection ports. The channel member has a surface formed with a plurality of openings through which respective ones of the plurality of pressure chambers are exposed. The actuator includes a layered body disposed on the surface of the channel member so as to confront the plurality of openings for applying energy to liquid in the plurality of pressure chambers. The layered body includes a first piezoelectric layer and a second piezoelectric layer both sandwiched between electrodes with respect to a stacking direction. The first piezoelectric layer is formed thereon with a plurality of independent electrodes separated from one another and arranged at positions corresponding to respective ones of the plurality of openings. The first piezoelectric layer has a plurality of independent active portions at positions where the plurality of independent electrodes is located. The plurality of independent active portions is capable of displacing selectively. The second piezoelectric layer is formed thereon with a plurality of individual electrodes connected by connection electrodes and arranged at positions corresponding to the respective ones of the plurality of openings. The second piezoelectric layer has a plurality of individual active portions at positions where the plurality of individual electrodes is located. The plurality of individual active portions is incapable of displacing selectively. Each of the plurality of openings has a shape that is longer in one direction parallel to the surface than in another direction intersecting the one direction and parallel to the surface. Each of the plurality of individual electrodes has a shape that is longer in the one direction than in the another direction. The connection electrodes connect one-direction ends of the plurality of individual electrodes with one another, the one-direction ends being ends in the one direction.

BRIEF DESCRIPTION OF THE DRAWINGS

Embodiments in accordance with the invention will be described in detail with reference to the following figures wherein.

DETAILED DESCRIPTION

Figure 1:
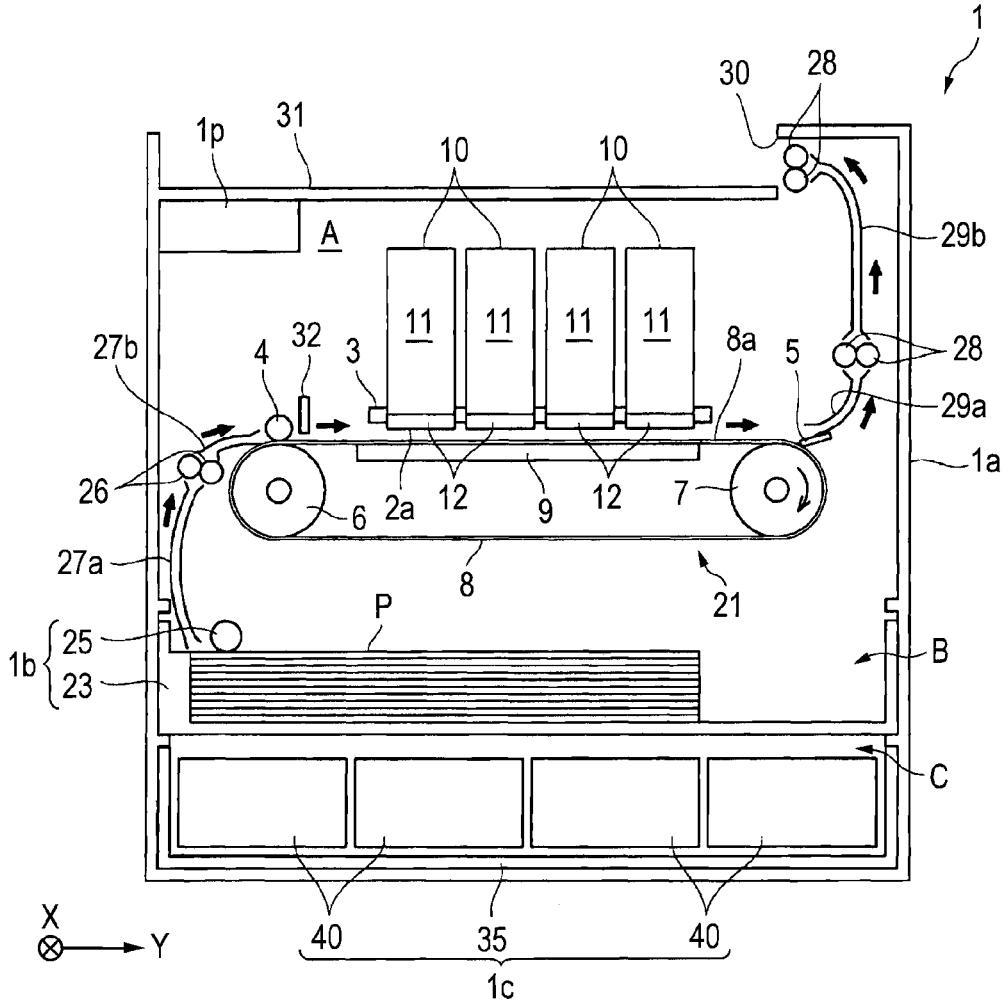
FIG. 1 is a schematic side view showing the internal structure of an inkjet-type printer including an inkjet head according to a first embodiment of the invention.

A droplet ejecting head according to some aspects of the invention will be described while referring to the accompanying drawings. In the following description, the expressions "upper" and "lower" are used to define the various parts when a droplet ejecting device including the droplet ejecting head is disposed in an orientation in which it is intended to be used.

First, the overall configuration of an inkjet-type printer 1 including an inkjet head 10 according to a first embodiment will be described while referring to FIG. 1.

The printer 1 has a casing 1*a* having a rectangular parallelepiped shape. A paper discharging section 31 is provided on a top plate of the casing 1*a*. The internal space of the casing 1*a* is divided into spaces A, B, and C in this order from the top. The spaces A and B are spaces in which a paper conveying path leading to the paper discharging section 31 is formed. In the space A, conveyance of paper P and image formation onto paper P are performed. In the space B, operations for feeding paper are performed. In the space C, an ink cartridge 40 as an ink supply source is accommodated.

Four inkjet heads 10, a conveying unit 21 that conveys paper P, a guide unit (described later) that guides paper P, and the like are arranged in the space A. A controller 1*p* is disposed at the top part of the space A. The controller 1*p* controls operations of each section of the printer 1 including these mechanisms and manages the overall operations of the printer 1.

The controller 1*p* includes a CPU (Central Processing Unit), a ROM (Read Only Memory), a RAM (Random Access Memory: including non-volatile RAM), ASIC (Application Specific Integrated Circuit), I/F (Interface), I/O (Input/Output Port), and the like. The ROM stores programs executed by the CPU, various constant data, and the like. The RAM temporarily stores data (image data, for example) that are required when the programs are executed. The ASIC performs rewriting, rearrangement, etc. of image data (signal processing and image processing). The I/F transmits data to and receives data from a higher-level device. The I/O performs input/output of detection signals of various signals. The controller 1*p* controls each section of the printer 1 so as to perform preparatory operations for image formation, operations for supplying, conveying, and discharging paper P, an ink ejecting operation in synchronous with conveyance of paper P, and the like, by cooperation between these hardware configurations and the programs in the ROM.

Each head 10 is a line head having substantially a rectangular parallelepiped shape elongated in a main scanning direction X. The four heads 10 are arranged in a sub-scanning direction Y with a predetermined pitch, and are supported by the casing 1*a* via a head frame 3. Each head 10 includes a channel unit 12, eight actuator units 17 (see FIG. 2), and a reservoir unit 11. During image formation, ink droplets of magenta, cyan, yellow, and black colors are ejected from the lower surface (ejection surface 2*a*) of a corresponding one of the four heads 10, respectively. More specific configurations of the heads 10 will be described later in greater detail.

As shown in FIG. 1, the conveying unit 21 includes belt rollers 6 and 7, an endless-type conveying belt 8 looped around the both rollers 6 and 7, a nip roller 4 and a separation plate 5 arranged outside the conveying belt 8, a platen 9 disposed inside the conveying belt 8, and the like.

The belt roller 7 is a drive roller, and rotates by driving of a conveying motor (not shown) in the clockwise direction in FIG. 1. Rotation of the belt roller 7 causes the conveying belt 8 to move in directions shown by the thick arrows in FIG. 1. The belt roller 6 is a follow roller, and rotates in the clockwise direction in FIG. 1 by following the movement of the conveying belt 8. The nip roller 4 is disposed to confront the belt roller 6, and presses paper P supplied from an upstream-side guide section (described later) against an outer peripheral surface 8*a* of the conveying belt 8. The separation plate 5 is disposed to confront the belt roller 7, and separates paper P from the outer peripheral surface 8*a* and guides the same to a downstream-side guide section (described later). The platen 9 is disposed to confront the four heads 10, and supports an upper loop of the conveying belt 8 from the inside. With this arrangement, a predetermined gap suitable for image formation is formed between the outer peripheral surface 8*a* and the ejection surfaces 2*a* of the heads 10.

The guide unit includes the upstream-side guide section and the downstream-side guide section which are arranged with the conveying unit 21 interposed therebetween. The upstream-side guide section includes two guides 27*a* and 27*b* and a pair of feed rollers 26. The upstream-side guide section connects a paper supplying unit 1*b* (described later) and the conveying unit 21. The downstream-side guide section includes two guides 29*a* and 29*b* and two pairs of feed rollers 28. The downstream-side guide section connects the conveying unit 21 and the paper discharging section 31.

In the space B, the paper supplying unit 1*b* is disposed so as to be detachable from the casing 1*a*. The paper supplying unit 1*b* includes a paper supplying tray 23 and a paper supplying roller 25. The paper supplying tray 23 is a box which is opened upward, and can accommodate paper P in a plurality of sizes. The paper supplying roller 25 picks up paper P at the topmost position in the paper supplying tray 23 and supplies the same to the upstream-side guide section.

As described above, in the spaces A and B, a paper conveying path is formed from the paper supplying unit 1*b* via the conveying unit 21 to the paper discharging section 31. Based on a print command, the controller 1*p* drives a paper supplying motor (not shown) for the paper supplying roller 25, a feed motor (not shown) for feed rollers of each guide section, the conveying motor, and the like. Paper P sent out of the paper supplying tray 23 is supplied to the conveying unit 21 by the pair of feed rollers 26. When the paper P passes positions directly below each head 10 in the sub-scanning direction Y, ink droplets are ejected from the ejection surfaces 2*a* sequentially so that a color image is formed on the paper P. Ejecting operations of ink droplets are performed based on detection signals from a paper sensor 32. The paper P is then separated by the separation plate 5 and is conveyed upward by the two pairs of feed rollers 28. Further, the paper P is discharged onto the paper discharging section 31 through an opening 30 at the top of the apparatus.

Here, the sub-scanning direction Y is a direction parallel to the conveying direction of paper P by the conveying unit 21. The main scanning direction X is a direction parallel to a horizontal surface and perpendicular to the sub-scanning direction Y.

In the space C, an ink unit 1*c* is disposed so as to be detachable from the casing 1*a*. The ink unit 1*c* includes a cartridge tray 35 and four cartridges 40 arranged side by side within the cartridge tray 35. Each cartridge 40 supplies ink to a corresponding one of the heads 10 via an ink tube (not shown).

The configuration of the heads 10 will be described in greater detail with reference to FIGS. 2 through 5. Note that, in FIG. 3, pressure chambers 16 and apertures 15 are located below the actuator units 17 and should be strictly shown in dotted lines, but these are shown in the solid lines for simplicity in FIG. 3.

Figure 5:
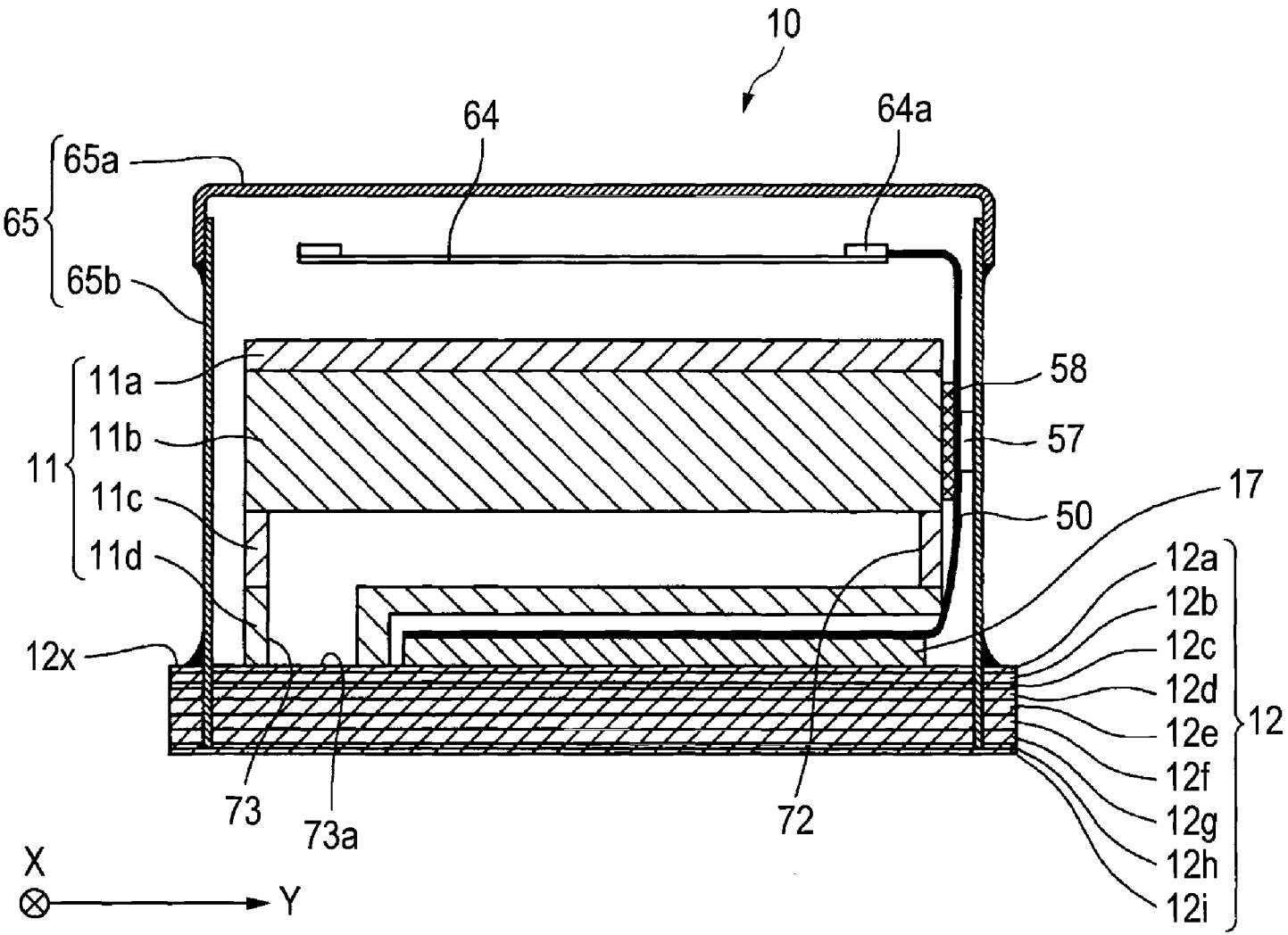
FIG. 5 is a vertical cross-sectional view of the inkjet head.

As shown in FIG. 5, the head 10 is a layered body in which the channel unit 12, the actuator unit 17, the reservoir unit 11, and a board 64 are stacked. Among these, the actuator unit 17, the reservoir unit 11, and the board 64 are accommodated in a space defined by an upper surface 12*x* of the channel unit 12 and a cover 65. In this space, a FPC (flat flexible print circuit board) 50 electrically connects the actuator unit 17 and the board 64. A driver IC 57 is mounted on the FPC 50.

As shown in FIG. 5, the cover 65 includes a top cover 65*a* and a side cover 65*b*. The cover 65 is a box which is opened downward, and is fixed to the upper surface 12*x* of the channel unit 12. Silicone materials are filled in the boundary between the both covers 65*a* and 65*b* and in the boundary between the side cover 65*b* and the upper surface 12*x*. The side cover 65*b* is made of an aluminum plate and also functions as a heat-sink. The driver IC 57 abut on the inner surface of the side cover 65*b* and is thermally coupled to the side cover 65*b*. Note that, in order to ensure the thermal coupling, the driver IC 57 is urged by an elastic member 58 (for example, a sponge) fixed to the side surface of the reservoir unit 11 toward the side cover 65*b* side.

The reservoir unit 11 is a layered body in which four metal plates 11*a*-11*d* formed with through holes and concave portions are bonded with one another. An ink channel is formed inside the reservoir unit 11. The plate 11*c* is formed with a reservoir 72 that temporarily stores ink. One end of the ink channel is connected to the cartridge 40 via a tube or the like, whereas the other end opens in the lower surface of the reservoir unit 11. As shown in FIG. 5, the lower surface of the plate 11*d* is formed with concavities and convexities. The concavities provide spaces between the plate 11*d* and the upper surface 12*x*. The actuator unit 17 is fixed to the upper surface 12*x* in this space. A certain gap is formed between the concavities of the lower surface of the plate 11*d* and the FPC 50 on the actuator unit 17. The plate 11*d* is formed with an ink outflow channel 73 (a part of the ink channel of the reservoir unit 11) in fluid communication with the reservoir 72. The ink outflow channel 73 opens in an end surface of the convex portion of the lower surface of the plate 11*d* (that is, the surface bonded with the upper surface 12*x*).

Figure 2:
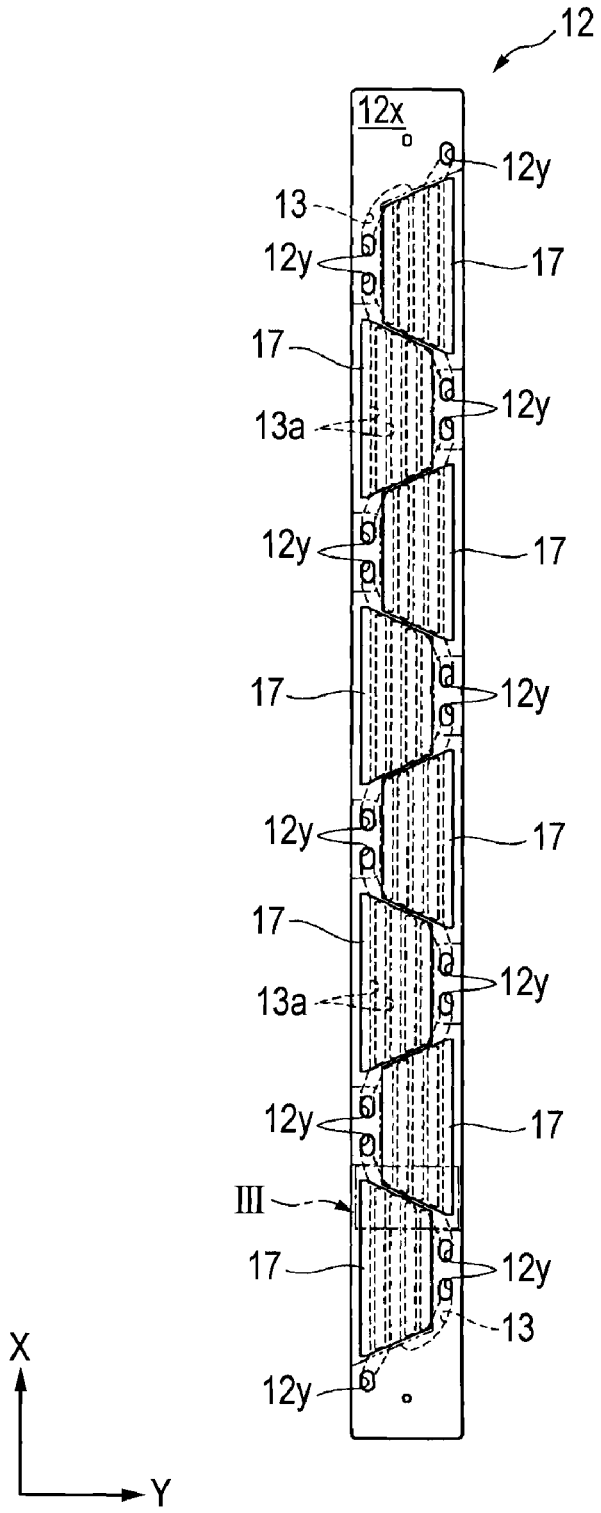
FIG. 2 is a plan view showing a channel unit and actuator units of the inkjet head in FIG. 1.
Figure 3:
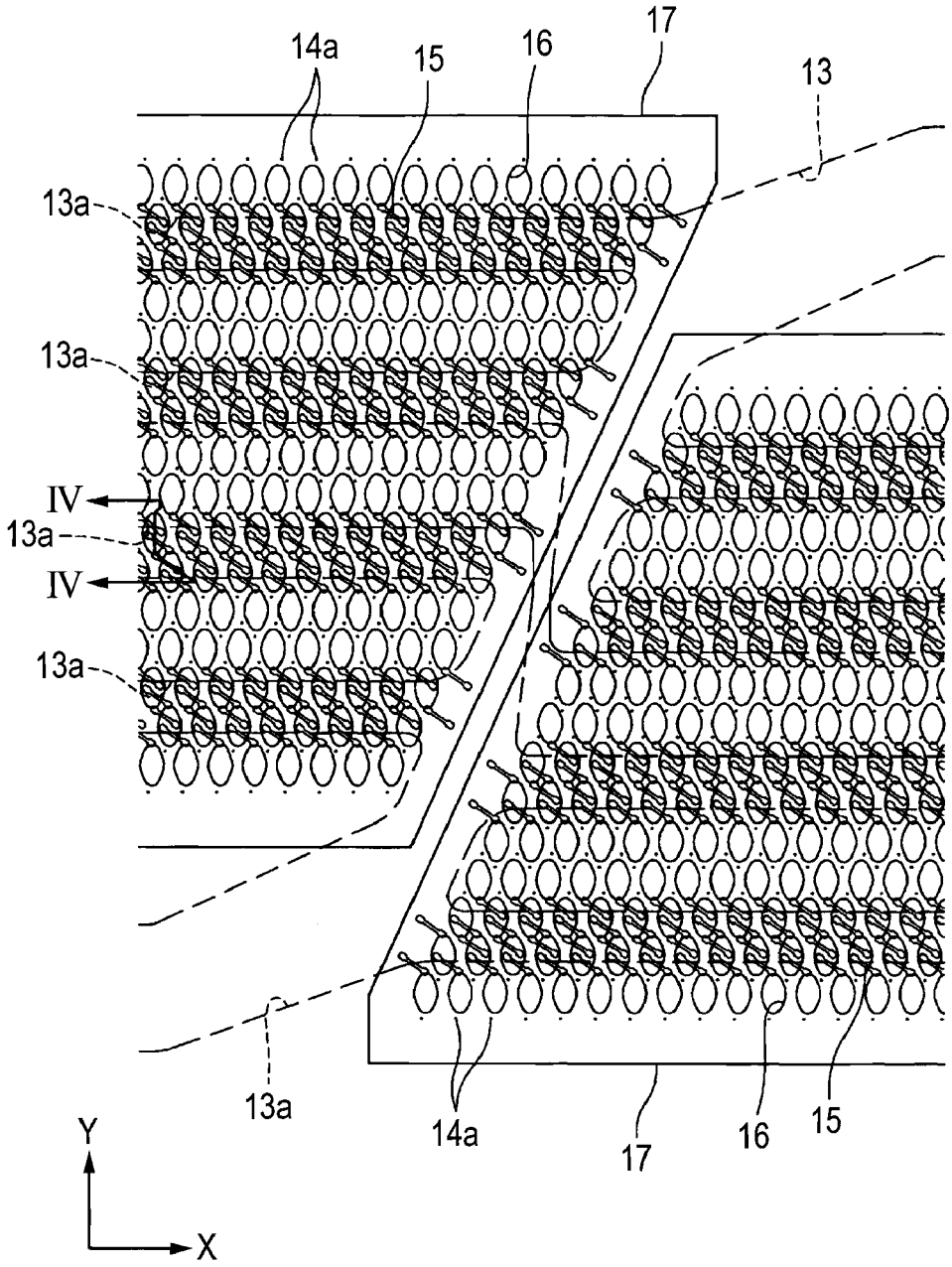
FIG. 3 is an enlarged view showing a region III surrounded by the single-dot chain line in FIG. 2.
Figure 4:
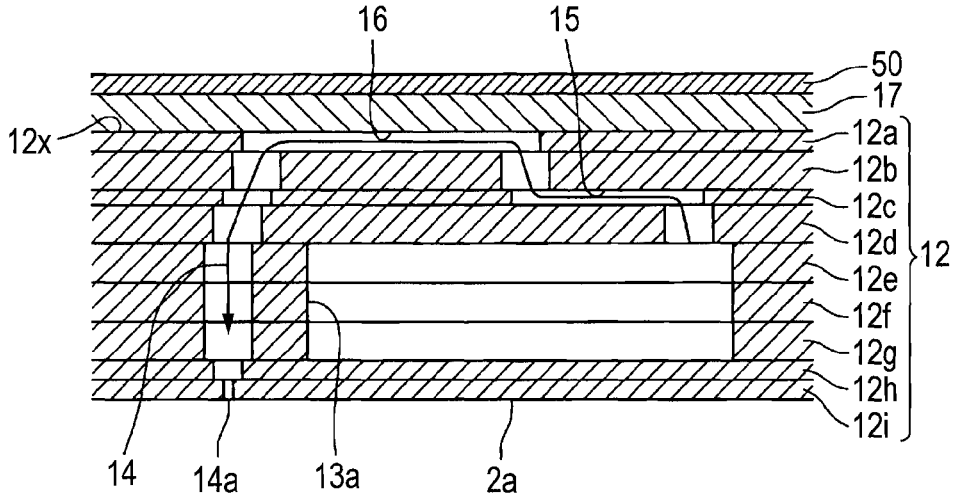
FIG. 4 is a partial cross-sectional view along a line IV-IV in FIG. 3.

The channel unit 12 is a layered body in which nine rectangular-shaped metal plates 12*a*, 12*b*, 12*c*, 12*d*, 12*e*, 12*f*, 12*g*, 12*h*, and 12*i* having substantially the same size (see FIG. 4) are bonded with one another. As shown in FIG. 2, the upper surface 12*x* of the channel unit 12 is formed with openings 12*y* in confrontation with a corresponding one of openings 73*a* of the ink outflow channel 73. Within the channel unit 12, ink channels are formed to connect from the openings 12*y* to ejection ports 14*a*. As shown in FIGS. 2, 3, and 4, the ink channel includes a manifold channel 13 having the opening 12*y* at one end thereof, subsidiary manifold channels 13*a* branching off from the manifold channel 13, and individual ink channels 14 running from outlets of the subsidiary manifold channels 13*a* via the pressure chambers 16 to the ejection ports 14*a*. As shown in FIG. 4, the individual ink channel 14 is formed for each ejection port 14*a*, and includes an aperture 15 functioning as an aperture for adjusting channel resistance. In addition, a large number of the pressure chambers 16 opens in the upper surface 12*x*. The opening of each pressure chamber 16 has substantially a diamond shape. The openings of the pressure chambers 16 are arranged in a matrix configuration so as to form a total of eight pressure-chamber groups each occupying substantially a trapezoidal region in a plan view. Like the pressure chambers 16, the ejection ports 14*a* opening in the ejection surface 2*a* are arranged in a matrix configuration so as to form a total of eight ejection-port groups each occupying substantially a trapezoidal region in a plan view.

As shown in FIG. 2, each actuator unit 17 has a trapezoidal shape in plan view. The actuator units 17 are arranged in a staggered configuration (in two rows) on the upper surface 12*x* of the channel unit 12. Further, as shown in FIG. 3, each actuator unit 17 is arranged on a trapezoidal region occupied by a pressure-chamber group (ejection-port group). For each of the actuator units 17, the lower base of a trapezoidal shape is located adjacent to an end of the channel unit 12 in the sub-scanning direction Y. The actuator units 17 are arranged so as to avoid a convex portion of the lower surface of the reservoir unit 11. The lower base of the trapezoidal shape of each actuator unit 17 is interposed between the openings 12*y* (the opening 73*a*) from the both sides in the main scanning direction X.

The FPC 50 is provided for each actuator unit 17. Wiring corresponding to each electrode of the actuator unit 17 is connected to a corresponding one of the output terminals of the driver IC 57. Under controls by the controller 1*p* (see FIG. 1), the FPC 50 transmits various driving signals adjusted in the board 64 to the driver IC 57, and transmits each driving voltage generated by the driver IC 57 to the actuator unit 17. The driving voltage is selectively applied to each electrode of the actuator unit 17.

Next, the configuration of the actuator unit 17 will be described with reference to FIGS. 6A through 6C.

Figure 6A:
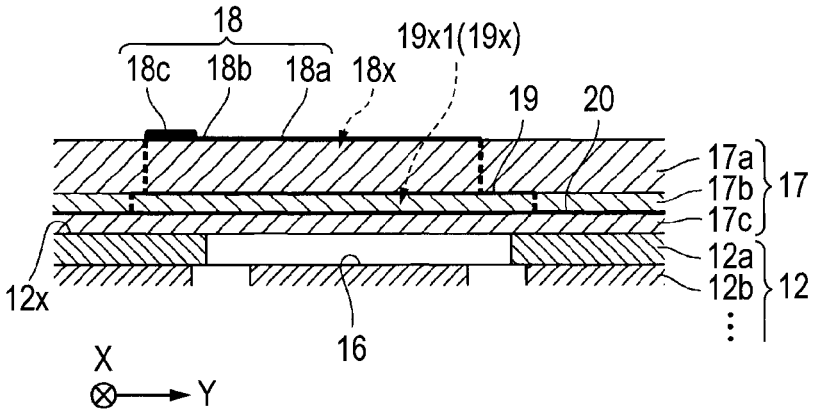
FIG. 6A is a partial cross-sectional view showing one of the actuator units in FIG. 2.
Figure 6B:
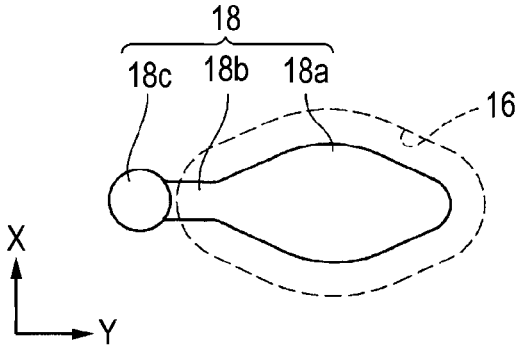
FIG. 6B is a plan view showing an independent electrode included in the actuator unit.

As shown in FIG. 6A, the actuator unit 17 includes a layered body including two piezoelectric layers 17*a* and 17*b* sandwiched between electrodes with respect to the stacking direction, and a vibration plate 17*c* arranged between the layered body and the channel unit 12. The piezoelectric layers 17*a* and 17*b* and the vibration plate 17*c* are all sheet-like members made of ceramic materials of lead zirconate titanate (PZT) series having ferroelectricity. The piezoelectric layers 17*a* and 17*b* and the vibration plate 17*c* have the same size and shape (trapezoidal shape) as viewed in the stacking direction of the piezoelectric layers 17*a* and 17*b*. The vibration plate 17*c* covers openings of a pressure-chamber group (a large number of the pressure chambers 16) formed in the upper surface 12*x* of the channel unit 12. The thickness of the piezoelectric layer 17*a*, which is the outermost layer, is greater than a sum of the thickness of the piezoelectric layer 17*b* and the thickness of the vibration plate 17*c*. The piezoelectric layers 17*a* and 17*b* are polarized in the same direction along the stacking direction.

The upper surface of the piezoelectric layer 17*a* is formed with a large number of independent electrodes 18 corresponding to the respective ones of the pressure chambers 16. An internal electrode 19 is formed between the piezoelectric layer 17*a* and the piezoelectric layer 17*b* under the piezoelectric layer 17*a*. A common electrode 20 is formed between the piezoelectric layer 17*b* and the vibration plate 17*c* under the piezoelectric layer 17*b*. No electrode is formed on the lower surface of the vibration plate 17*c*. The internal electrode 19 is formed on the upper surface of the piezoelectric layer 17*b*, and the common electrode 20 is formed on the upper surface of the vibration plate 17*c*.

The independent electrodes 18 are provided independently for respective ones of the pressure chambers 16. Like the pressure chambers 16, the independent electrodes 18 are arranged in a matrix configuration so as to form a plurality of rows and a plurality of columns. As shown in FIG. 6B, each independent electrode 18 includes a main electrode region 18*a* having substantially a diamond shape, an extension portion 18*b* extending from one of the acute angle portions of the main electrode region 18*a*, and a land 18*c* formed on the extension portion 18*b*. The shape of the main electrode region 18*a* is a similarity shape to that of the opening of the pressure chamber 16, while the size of the main electrode region 18*a* is smaller than that of the opening of the pressure chamber 16. In a plan view, the main electrode region 18*a* is arranged within the opening of the pressure chamber 16. The extension portion 18*b* extends to a region outside of the opening of the pressure chamber 16, and the land 18*c* is arranged at a distal end of the extension portion 18*b*. The land 18*c* has a circular shape in a plan view, and does not confront the pressure chamber 16. The land 18*c* has a height of approximately 50 μm (micrometers) from the upper surface of the piezoelectric layer 17*a*. The land 18*c* is electrically connected to an electrode of wiring of the FPC 50. The piezoelectric layer 17*a* and the FPC 50 confront each other with a gap of approximately 50 μm (micrometers), at regions except the electrical connection point. With this configuration, free deformation of the actuator units 17 can be ensured.

The internal electrode 19 is an electrode relating to meniscus vibration. As shown in FIG. 6C, the internal electrode 19 includes a large number of individual electrodes 19*a* that confronts the respective ones of the openings of the pressure chambers 16, and a large number of connection electrodes 19*b* that connects the individual electrodes 19*a* with one another.

The shape of each individual electrode 19*a* is a similarity shape to that of the opening of the pressure chamber 16 as viewed in the stacking direction of the piezoelectric layers 17*a* and 17*b*. The size of the individual electrode 19*a* is larger than that of the opening of the pressure chamber 16. In a plan view, the individual electrode 19*a* includes the opening of the pressure chamber 16 therein.

The individual electrodes 19*a* are arranged at regular intervals along the longitudinal direction of the head 10 (the main scanning direction X) on the upper surface of the piezoelectric layer 17*b*, thereby constituting a plurality of individual-electrode rows. These individual-electrode rows are parallel to one another. An acute angle portion of the individual electrode 19*a* is interposed between two individual electrodes 19*a* included in an adjacent individual-electrode row. The individual electrodes 19*a* are arranged in a staggered configuration along the main scanning direction X, and constitutes sixteen (16) individual-electrode rows. All of the individual electrodes 19*a* of the internal electrode 19 formed on one actuator unit 17 are connected with one another by the connection electrodes 19*b*, and thus are kept at the same electric potential.

The connection electrodes 19*b* connect distal ends 19*a*1 (lengthwise ends) of acute angle portions of the individual electrodes 19*a* along the main scanning direction X. Two connection electrodes 19*b* extend from each end 19*a*1 so as to be symmetric with respect to the line passing through the end 19*a*1 along the sub-scanning direction Y. In the present embodiment, as shown in FIG. 6C, the connection electrodes 19*b* are interposed between two individual-electrode rows adjacent to each other in the sub-scanning direction Y. Two connection electrodes 19*b* extend from one of the ends 19*a*1 of the individual electrode 19*a*, and connect respectively to the other side of the ends 19*a*1 of two individual electrodes 19*a* interposing said individual electrode 19*a* therebetween in the main scanning direction X. Here, the two individual electrodes 19*a* interposing said individual electrode 19*a* therebetween belong to another individual-electrode row positioned adjacently in the sub-scanning direction Y. As a whole, the connection electrodes 19*b* extend in a staggered shape along the main scanning direction X.

The common electrode 20 is an electrode shared by all the pressure chambers 16 corresponding to one actuator unit 17. The common electrode 20 is formed on the entire surface of the vibration plate 17*c*. With this configuration, an electric field that is generated in each of the piezoelectric layers 17*a* and 17*b* is insulated against the pressure chamber 16 side. The common electrode 20 is always kept at a ground potential.

The upper surface of the piezoelectric layer 17*a* is formed with a land for the internal electrode (not shown) and a land for the common electrode (not shown), in addition to the land 18*c* for the independent electrode. On this upper surface, the lands 18*c* for the independent electrodes occupy a region of a trapezoidal shape which is a similarity shape to the upper surface at the center part of the upper surface. The land for the common electrode is arranged near each of four corners of a trapezoidal shape on the upper surface. The land for the internal electrode is arranged at substantially the center of each oblique side of the upper surface. The land for the internal electrode is electrically connected to the internal electrode 19 via a through hole of the piezoelectric layer 17*a*. The land for the common electrode is electrically connected to the common electrode 20 via a through hole penetrating the piezoelectric layers 17*a* and 17*b*. Each land is connected with terminals of the FPC 50. Among these, the land for the common electrode is connected with a wiring connected to ground, and the land for the internal electrode is connected with a wiring extending from the output terminal of the driver IC 57.

A part of each of the piezoelectric layers 17*a* and 17*b* functions as an active portion, the part being interposed between the electrodes 18, 19, and 20. The piezoelectric layer 17*a* includes an independent active portion 18*x* at a part interposed between the electrodes 18 and 19, where the independent active portion 18*x* is capable of displacing selectively. The piezoelectric layer 17*b* includes an internal active portion 19*x* at a part interposed between the electrodes 19 and 20, where the internal active portion 19*x* is incapable of displacing selectively. The internal active portion 19*x* includes an individual active portion 19*x*1 in confrontation with the individual electrode 19*a* and a connection active portion (not shown) in confrontation with the connection electrode 19*b*. In the actuator unit 17, the active portions 18*x* and 19*x* stacked vertically are arranged to confront the opening of the pressure chamber 16, so that energy can be added to ink within the pressure chamber 16 by displacement of the two active portions 18*x* and 19*x*. That is, the actuator unit 17 includes a piezoelectric-type actuator for each pressure chamber 16. Each active portion may be displaced in at least one vibration mode selected from among $d_{31}$, $d_{33}$, and $d_{15}$.

An electric field is generated in the independent active portion 18*x* due to a potential difference between the independent electrode 18 and the internal electrode 19. Similarly, an electric field is generated in the internal active portion 19*x* due to a potential difference between the internal electrode 19 and the common electrode 20. If an electric field is generated in the same direction as the polarizing direction, each of the active portions 18*x* and 19*x* contracts in the surface direction by the piezoelectric lateral effect. In contrast, a portion of the vibration plate 17*c* in confrontation with the active portion with respect to the thickness direction (non-active portion) does not deform by itself, even if an electric field is generated. At this time, because difference in deformation occurs between the both (between the piezoelectric layers 17*a*, 17*b* and the vibration plate 17*c*), the actuator as a whole deforms to be convex toward the pressure chamber 16. Each actuator having this configuration is a so-called unimorph-type piezoelectric element.

In the actuator unit 17, the two active portions 18*x* and 19*x* stacked vertically have difference roles. That is, displacement of the independent active portion 18*x* contributes to ejection of an ink droplet for image formation, whereas displacement of the internal active portion 19*x* contributes to flushing. In this way, the two active portions 18*x* and 19*x* stacked vertically have separate roles. It can be said that each actuator is a layered body of two unimorph-type piezoelectric elements sharing the vibration plate 17*c*.

Flushing includes both of ejection flushing of ejecting ink droplets from the ejection port 14*a* by driving of the actuator unit 17 and non-ejection flushing of vibrating a meniscus formed in the ejection port 14*a* without ejecting an ink droplet from the ejection port 14*a* by driving of the actuator unit 17.

Especially when ink with high viscosity and quick drying characteristics is used, an increase in viscosity of ink and hardening of ink tend to occur near the ejection port 14*a*. However, by performing flushing, it is possible to maintain conditions of menisci and to well maintain recording quality.

The non-ejection flushing is performed during recording onto one sheet of paper P, between sheets of paper P, and the like. The phrase "during recording onto one sheet of paper P" indicates a period in which one sheet of paper P being conveyed based on controls by the controller 1*p* is in confrontation with the ejection ports 14*a* of each head 10. The phrase "between sheets of paper P" indicates a period in which, when two or more sheets of paper P are conveyed continuously, no sheet of paper P is in confrontation with the ejection ports 14*a* of the head 10 after recording onto a previous sheet of paper P is finished and before recording onto a subsequent sheet of paper P is performed, the previous sheet and the subsequent sheet of paper P being two sheets of paper P arranged in the conveying direction. The ejection flushing is performed, for example, at the time when a recording ejection operation by the head 10 (an operation of ejecting ink droplets from the ejection ports 14*a* based on image data) is not performed for a predetermined period or more and immediately before the recording ejection operation is restarted. During the ejection flushing, a state is maintained that a cap (not shown) covers the ejection surface 2*a* at the maintenance position.

During image formation, each independent electrode 18 is selectively applied with a potential change while keeping the internal electrode 19 and the common electrode 20 at a ground potential, thereby applying driving voltage for image formation only to the piezoelectric layer 17*a*. That is, only the independent active portion 18*x* is displaced without displacing the internal active portion 19*x*. As a method of driving the actuator unit 17 at this time, for example, a so-called "pull and eject method" may be adopted where an ink supply operation is performed prior to an ink-droplet ejection operation corresponding to one voltage pulse, assuming that each independent active portion 18*x* is displaced with the vibration mode $d_{31}$. Alternatively, a so-called "push and eject method" may be adopted where an ink supply operation is not performed prior to an ink-droplet ejection operation corresponding to one voltage pulse, assuming that each independent active portion 18*x* is displaced with the vibration mode $d_{33}$. In the "pull and eject method", specifically, the actuator is preliminary kept at a state of being convex toward the pressure chamber 16 and, when driving voltage is applied, the actuator is temporarily made flat. Thus, the volume of the pressure chamber 16 increases, and supply of ink is started from the subsidiary manifold channel 13*a* to the pressure chamber 16. Then, at the timing when supplied ink reaches the pressure chamber 16, the actuator is deformed to be convex toward the pressure chamber 16. Thus, the volume of the pressure chamber 16 decreases, and pressure applied to ink within the pressure chamber 16 increases, so that this ink is ejected from the ejection port 14*a* as an ink droplet. The "push and eject method" is a method in which the actuator is preliminary kept flat and, when driving voltage is applied, the actuator is deformed to be convex toward the pressure chamber 16, so that an ink droplet is ejected from the ejection port 14*a*.

During the flushing, for example, both of the independent electrode 18 and the internal electrode 19 are applied with pulse-shaped potentials that change at the same timing and at the same potential values, while keeping the common electrode 20 at a ground potential, thereby applying a driving voltage for flushing only to the piezoelectric layer 17*b*. That is, the electric potentials of the independent electrode 18 and the internal electrode 19 are controlled to be the same relative to the common electrode 20, thereby displacing only the internal active portion 19*x*, without displacing the independent active portion 18*x*. Driving voltage for non-ejection flushing may include a plurality of voltage pulses having narrower pulse widths than voltage pulses of driving voltage for image formation. The driving voltage for ejection flushing may be the same as the driving voltage for the maximum number of ejection ink droplets (three droplets, for example) among a plurality of kinds of driving voltages for image formation.

As described above, according to the head 10 of the present embodiment, the connection electrodes 19*b* connect the lengthwise ends 19*a*1 of the individual electrodes 19*a* (portions of the individual active portions 19*x*1 at which the amount of displacement at application of voltage is relatively small). Thus, even if connection active portions (portions of the piezoelectric layer 17*b* at which the connection electrodes 19*b* are formed) are displaced when voltage is applied to the individual active portion 19*x*1, it is possible to suppress an influence of this displacement on deformation of the individual active portion 19*x*1. That is, it is possible to suppress worsening of deformation efficiency of the individual active portion 19*x*1 in the piezoelectric layer 17*b*, which is used for flushing.

In addition, because worsening of deformation efficiency can be suppressed in the individual active portion 19*x*1, desired deformation can be ensured without increasing application voltage. Accordingly, power consumption can be reduced, and deterioration of piezoelectric performance of the piezoelectric layer 17*b* caused by a voltage increase can be suppressed, thereby increasing life of the piezoelectric layer.

Because the actuator is provided with the piezoelectric layer 17*b* for flushing in addition to the piezoelectric layer 17*a* for recording, the number of times of deformation of the piezoelectric layer for recording due to voltage application can be reduced, compared with the case where one piezoelectric layer is used both for recording and for flushing. Hence, deterioration of piezoelectric performance of the piezoelectric layer 17*a* for recording can be suppressed, and thus deterioration of durability of the actuator including the piezoelectric layer 17*a* can be suppressed. Thus, recording quality can be well kept by maintaining conditions of menisci, while suppressing deterioration of durability of the actuator.

Because, out of the piezoelectric layers 17*a* and 17*b*, the piezoelectric layer 17*a* for recording is the furthest away from the upper surface 12*x* of the channel unit 12 and is the outermost layer, the piezoelectric layer 17*a* is less restrained, and has relatively high deformation efficiency. Accordingly, ejection for recording is performed efficiently, and an improvement in recording quality can be achieved. Further, because the independent electrodes 18 are formed on the surface of the piezoelectric layer 17*a*, alignment of the independent electrodes 18 relative to the openings of the pressure chambers 16 can be performed with a high precision and with ease, and also wiring to the independent electrodes 18 can be performed with ease.

The independent electrode 18 has a similarity shape to the opening of the corresponding pressure chamber 16 and a smaller size than the opening, as viewed in the stacking direction of the piezoelectric layers 17*a* and 17*b*. Hence, deformation efficiency of the independent active portion 18*x* can be improved.

The individual electrode 19*a* has a larger size than the opening of the corresponding pressure chamber 16 as viewed in the stacking direction of the piezoelectric layers 17*a* and 17*b*. According to this configuration, alignment of the individual electrode 19 relative to the opening of the pressure chamber 16 can be performed with a high precision and with ease, even when the piezoelectric layer 17*a* or 17*b* on which the individual electrode 19*a* is formed (sandwiching the individual electrode 19*a*) is contracted due to burning. This further increases deformation efficiency of the individual active portion 19*x*1.

The individual electrode 19*a* has a similarity shape to the opening of the corresponding pressure chamber 16, as viewed in the stacking direction of the piezoelectric layers 17*a* and 17*b*. With this configuration, alignment of the individual electrode 19*a* relative to the opening of the pressure chamber 16 can be performed with a high precision and with ease, and hence deformation efficiency of the individual active portion 19*x*1 can be improved.

The actuator unit 17 further includes the vibration plate 17*c* arranged between the piezoelectric layers 17*a*, 17*b* and the channel unit 12 so as to seal the openings of the pressure chambers 16. With this arrangement, in the actuator unit 17, it is possible to implement deformation of unimorph type, bimorph type, multimorph type, and the like, using the vibration plate 17*c*. Further, by interposing the vibration plate 17*c* between the piezoelectric layers 17*a*, 17*b* and the channel unit 12, it is possible to prevent electrical defect such as short circuit that may occur due to migration of ink ingredient within the pressure chamber 16 when voltage is applied to each of the piezoelectric layers 17*a* and 17*b*.

In the actuator unit 17, the plurality of electrodes 18, 19, and 20 arranged to correspond to the opening of the pressure chamber 16 in the stacking direction of the piezoelectric layers 17*a* and 17*b* have sizes that are smaller as a distance from the upper surface 12*x* of the channel unit 12 is larger. Specifically, among the electrodes 18, 19, and 20 arranged to correspond to each pressure chamber 16, the common electrode 20 has the largest size relative to the pressure chamber 16, the second largest is the internal electrode 19, and the independent electrode 18 is the smallest. With this configuration, even if the positions of the electrodes 18, 19, and 20 are deviated slightly, each of the active portions 18*x* and 19*x* can be secured.

The opening of the pressure chamber 16 has substantially a diamond shape of which a longer diagonal extends in the sub-scanning direction Y. With this arrangement, pressure wave generated during driving of the actuator propagates in the lengthwise direction of the opening, thereby ensuring good ejection performance. In addition, while securing a large area of the opening occupying in the upper surface 12*x* of the channel unit 12, the openings can be arranged in the upper surface 12*x* of the channel unit 12 with high density.

Figure 6C:
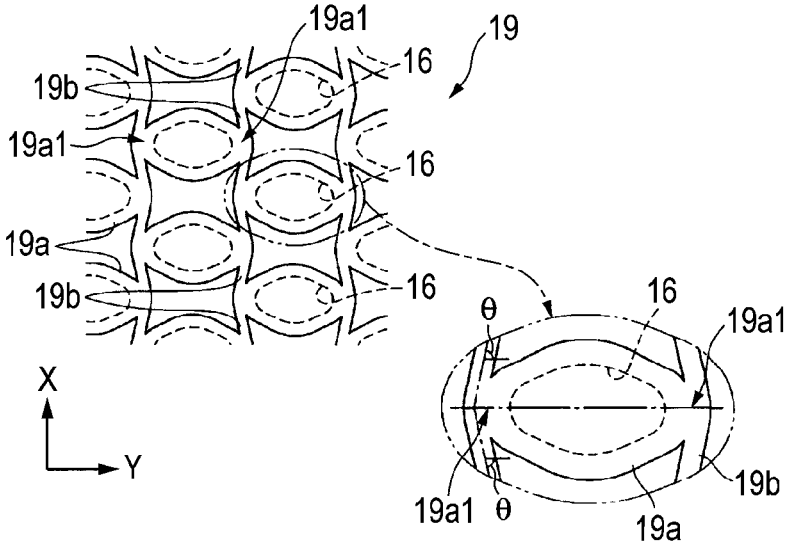
FIG. 6C is a plan view showing an internal electrode included in the actuator unit in FIG. 2.

The connection electrodes 19*b* extend in directions intersecting the sub-scanning direction Y (directions forming angle θ with respect to a line along the sub-scanning direction Y, as shown in a partial enlarged view of FIG. 6C) from the both lengthwise ends of each individual electrode 19*a*. With this configuration, worsening of deformation efficiency of the individual active portion 19*x*1 can be further suppressed.

In addition, angle θ is an acute angle close to a right angle (90 degrees) with respect to a line along the sub-scanning direction Y. Hence, worsening of deformation efficiency of the individual active portion 19*x*1 can be even further suppressed.

Two connection electrodes 19*b* extend from each lengthwise end 19*a*1 of the individual electrode 19*a*. With this configuration, reliability of connection by the connection electrodes 19*b* can be improved.

Additionally, the two connection electrodes 19*b* connect the individual electrode 19*a* having the end 19*a*1 which serves as a base end of these two connection electrodes 19*b* and two individual electrodes 19*a* different from each other. With this configuration, reliability of connection by the connection electrodes 19*b* can be further improved. That is, this individual electrode 19*a* is connected to different two individual electrodes 19*a* by two connection electrodes 19*b* extending from the lengthwise end 19*a*1 of one individual electrode 19*a*. One individual electrode 19*a* is connected to four individual electrodes 19*a* surrounding this individual electrode 19*a* (in oblique positional relationships with this individual electrode 19*a* with respect to the sub-scanning direction Y) via two connection electrodes 19*b* extending from each lengthwise end 19*a*1, that is, a total of four connection electrodes 19*b*.

In the actuator unit 17, the common electrode 20 closest to the upper surface 12*x* of the channel unit 12 is a ground electrode. If the common electrode 20 is not electrically connected to ground, potential difference is created between ink within the pressure chamber 16 and the common electrode 20, and migration of ink ingredient within the pressure chamber 16 can generate short circuit. In the present embodiment, however, this problem can be avoided.

The piezoelectric layers 17*a* and 17*b* are polarized in the same direction along the stacking direction. If the polarizing directions in the stacking direction of the piezoelectric layers 17*a* and 17*b* are opposite from each other, in addition to the common electrode 20, a cutoff electrode needs to be newly added in order to displace the piezoelectric layers 17*a* and 17*b* in the same direction. The cutoff electrode is an electrode connected to ground like the common electrode 20. The cutoff electrode cuts off, against ink, an electric field generated by the surface electrode 18 and the internal electrode 19 sandwiching the piezoelectric layers 17*a* and 17*b* with the common electrode 20. In this case, the added cutoff electrode function as a rigid body, and becomes a factor that hinders deformation of the actuator. In contrast, in the present embodiment, there is only one ground electrode, which is the common electrode 20, thereby suppressing worsening of efficiency in deformation of the actuator.

The common electrode 20 extends over the entirety of the surface of the piezoelectric layer 17*b* and the vibration plate 17*c*. With this arrangement, electrical defect caused by leakage electric field (for example, electrical short circuit due to electroendosmosis of ink ingredient in the opening of the pressure chamber 16) can be prevented.

All the individual electrodes 19*a* formed on the piezoelectric layer 17*b* are connected by the connection electrodes 19*b*. With this configuration, it is sufficient that wiring is provided to only one point of the individual electrode 19*a* or the connection electrode 19*b*, thereby simplifying the wiring configuration. Also, simplification of the configuration for supplying signals can be achieved.

Next, an inkjet head according to a second embodiment will be described while referring to FIG. 7. The head of the present embodiment differs from the first embodiment only in the configuration of an internal electrode, and the other configuration is the same as the first embodiment.

Figure 7:
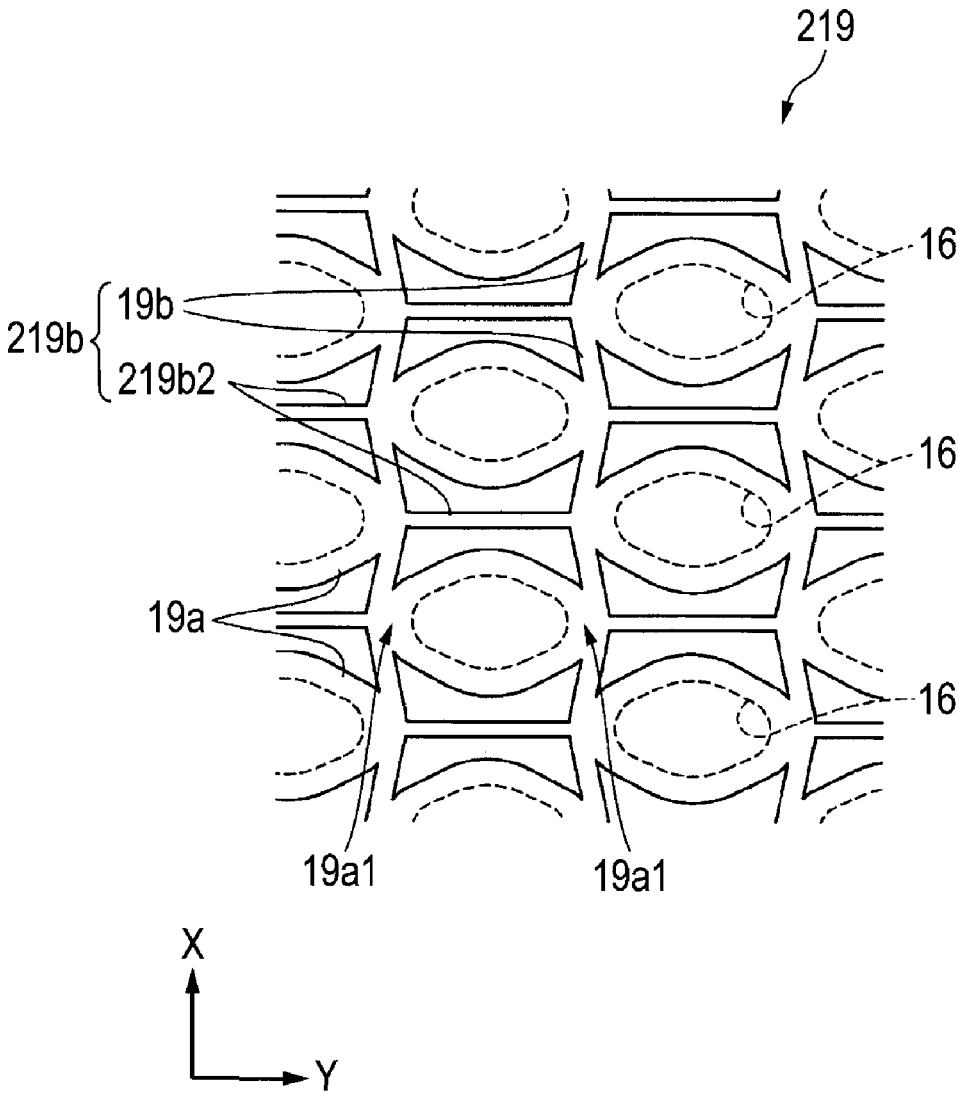
FIG. 7 is a plan view showing an internal electrode in an inkjet head according to a second embodiment of the invention.

As shown in FIG. 7, an internal electrode 219 of the present embodiment includes a large number of individual electrodes 19*a* similar to those in the first embodiment, and connection electrodes 219*b* that connect lengthwise ends 19*a*1 of the individual electrodes 19*a* with one another. Although the individual electrodes 19*a* are the same as the first embodiment, the connection electrodes 219*b* are different from the connection electrodes 19*b* of the first embodiment. The connection electrodes 219*b* are formed by adding connection electrodes 219*b*2, which extend linearly in the sub-scanning direction Y, to the connection electrodes 19*b* of the first embodiment, which extend in a zigzag shape in the main scanning direction X as a whole. The connection electrodes 219*b*2 connect two individual electrodes 19*a* interposing therebetween one individual-electrode row extending in the main scanning direction X. As shown in FIG. 7, each connection electrode 219*b*2 is arranged in the middle of two individual electrodes 19*a* adjacent to each other in the main scanning direction X.

As described above, according to the head of the present embodiment, three connection electrodes 219*b* extend from each lengthwise end 19*a*1 of the individual electrodes 19*a*. With this configuration, reliability of connection by the connection electrodes 219*b* can be further improved.

Additionally, these three connection electrodes 219*b* connect the individual electrode 19*a* having the lengthwise end 19*a*1 which serves as a base end of these three connection electrodes 219*b* and three individual electrodes 19*a* different from one another. With this configuration, reliability of connection by the connection electrodes 219*b* can be further improved. That is, this individual electrode 19*a* is connected to different three individual electrodes 19*a* by three connection electrodes 219*b* extending from each lengthwise end 19*a*1 of one individual electrode 19*a*. One individual electrode 19*a* is connected to six individual electrodes 19*a* surrounding this individual electrode 19*a* (four individual electrodes 19*a* in oblique positional relationships with this individual electrode 19*a* in the sub-scanning direction Y, and two individual electrodes 19*a* aligned with this individual electrode 19*a* in the sub-scanning direction Y) via three connection electrodes 219*b* extending from each lengthwise end 19*a*1, that is, a total of six connection electrodes 219*b*.

Next, an inkjet head according to a third embodiment will be described while referring to FIG. 8. The head of the present embodiment differs from the first embodiment only in the configuration of a common electrode, and the other configuration is the same as the first embodiment.

A common electrode 320 of the present embodiment is not formed on an entire surface of the piezoelectric layer 17*b*. As shown in FIG. 8, the common electrode 320 includes a large number of individual portions 320*a* in confrontation with respective ones of the individual electrodes 19*a*, and connection portions 320*b* that connect the individual portions 320*a* with one another. The individual portions 320*a* are formed in the same pattern as the individual electrodes 19*a*. Each individual portion 320*a* has the same shape and size as the individual electrode 19*a*, and is arranged in confrontation with a corresponding one of the individual electrodes 19*a* so as to be aligned with the individual electrode 19*a* as viewed from the stacking direction of the piezoelectric layers 17*a* and 17*b*. All the individual portions 320*a* of the common electrode 320 formed on one actuator unit 17 are connected with one another by the connection portions 320*b*, and thus kept at the same electric potential.

The connection portions 320*b* connect distal ends (lengthwise ends) 320*a*1 of acute angle portions of the individual portions 320*a*. One connection portion 320*b* extends linearly in the sub-scanning direction Y from each end 320*a*1. Each connection portion 320*b* connects two individual portions 320*a* interposing therebetween one row of individual portions 320*a* extending in the main scanning direction X. As shown in FIG. 8, each connection portion 320*b* is arranged in the middle of two individual portions 320*a* adjacent to each other in the main scanning direction X. The connection portions 320*b* are not in confrontation with the connection electrodes 19*b* in a plan view.

As described above, according to the head of the present embodiment, no electrode is arranged at portions on the lower surface of the piezoelectric layer 17*b* (the opposite side from the surface on which the internal electrode 19 is formed), the portions being in confrontation with the connection electrodes 19*b*. Accordingly, the portions of the piezoelectric layer 17*b* at which the connection electrodes 19*b* are formed are not portions (active portions) interposed between electrodes in the stacking direction, and are non-active portions. That is, the internal active portion 19*x* does not include the above-mentioned connection active portion, but only include the individual active portion 19*x*1. With this configuration, the portions of the piezoelectric layer 17*b* at which the connection electrodes 19*b* are formed are not displaced, when voltage is applied to the individual active portion 19*x*1. Hence, it is possible to suppress worsening of deformation efficiency of the individual active portion 19*x*1 more reliably.

Next, an inkjet head according to a fourth embodiment will be described while referring to FIG. 9. The head of the present embodiment differs from the first embodiment only in the configuration of an internal electrode, and the other configuration is the same as the first embodiment.

Figure 9:
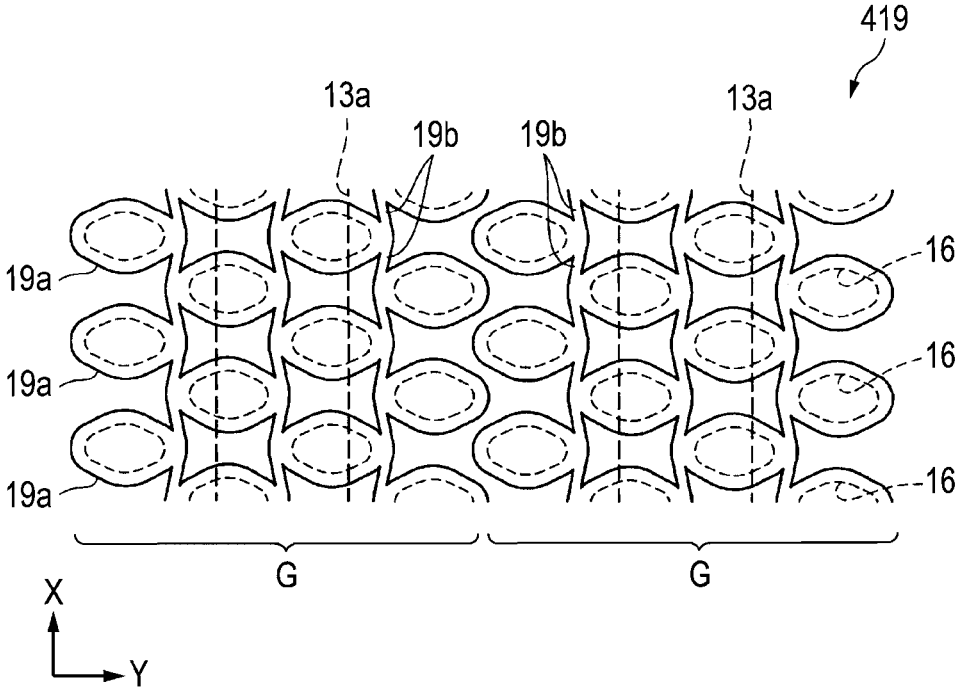
FIG. 9 is a plan view showing an internal electrode in an inkjet head according to a fourth embodiment of the invention.

As shown in FIG. 9, an internal electrode 419 of the present embodiment includes a large number of individual electrodes 19*a* similar to those in the first embodiment, and connection electrodes 19*b* that connect distal ends 19*a*1 of acute angle portions of the individual electrodes 19*a* with one another. Here, the connection electrodes 19*b* do not connect all the individual electrodes 19*a* of the internal electrode 419 formed on one actuator unit 17, but connect the individual electrodes 19*a* in each group G. One group G of the individual electrodes 19*a* is provided for each of subsidiary manifold channels 13*a* (see FIG. 3). That is, one group G is formed by the plurality of individual electrodes 19*a* in confrontation with respective ones of the openings of the plurality of pressure chambers 16 in communication with one subsidiary manifold channel 13*a*.

The individual electrodes 19*a* are arranged in a matrix configuration to form a plurality of rows and a plurality of columns, so as to correspond to the arrangement configuration of the openings of the pressure chambers 16. Here, defining the main scanning direction X as the row direction, four rows of the individual electrodes 19*a* each arranged in the row direction constitute one group G (Alternatively, if the main scanning direction X is defined as the column direction, four columns of the individual electrodes 19*a* each arranged in the column direction constitute one group G).

As described above, according to the head of the present embodiment, electric potential can be controlled for each group G of the individual electrodes 19*a*. Hence, crosstalk among groups G can be suppressed. Further, various control modes can be implemented, such as delay control of a certain group G.

In addition, each group G includes the individual electrodes 19*a* forming a plurality of rows or columns, not one row or column. With this configuration, compared with a case where groups each including only one row or one column of the individual electrodes 19*a* are connected electrically, wiring configuration and configuration for supplying signals to the individual electrodes 19*a* can be simplified.

Further, because the group G of the individual electrodes 19*a* is provided for each subsidiary manifold channel 13*a*, electric potential can be controlled for each group of the individual electrodes 19*a* corresponding to one subsidiary manifold channel 13*a*. Thus, fluid crosstalk (a phenomenon that mutual propagation of residual pressure waves is generated via the subsidiary manifold channel 13*a*) can be suppressed.

Note that, in terms of suppressing liquid crosstalk, in an individual electrode group G corresponding to one subsidiary manifold channel 13*a*, it is further preferable that four individual-electrode rows each extending in the main scanning direction X be separated individually.

In terms of uniformity of deformation performance of each actuator, in an individual electrode group G corresponding to one subsidiary manifold channel 13*a*, it is preferable that four individual-electrode rows each extending in the main scanning direction X be separated into two sets of inner two rows and outer two rows. In the present embodiment, each subsidiary manifold channel 13*a* extends in the main scanning direction X. Four individual-electrode rows of left two rows and right two rows are arranged symmetrically with the subsidiary manifold channel 13*a* as the center. Here, the inner two rows of the individual-electrode rows overlap the subsidiary manifold channel 13*a* in a larger area, in a plan view, than the outer two rows of the individual-electrode rows. Because the individual electrode group G is separated into two sets of inner two rows and outer two rows, difference in deformation performance based on the difference in the overlapping area can be coped with.

While the invention has been described in detail with reference to the above embodiments thereof, it would be apparent to those skilled in the art that various changes and modifications may be made therein without departing from the scope of the claims.

The arrangement and shape of the piezoelectric layers and electrodes included in the actuator as well as the deformation mode of the actuator are not limited to those described in the above embodiments and may be modified in various ways.

For example, in the actuator unit 17, another element (another electrode, piezoelectric layer, and the like) may be sandwiched between the piezoelectric layers 17*a* and 17*b*, and/or, between the piezoelectric layer 17*b* and the vibration plate 17*c*. Further, the vibration plate 17*c* may be omitted.

The invention is not limited to that each independent electrode 18 has a similarity shape to the shape of the opening of the corresponding pressure chamber 16 and has a size smaller than the opening as viewed in the stacking direction of the piezoelectric layers 17*a* and 17*b*. The independent electrode 18 may have various shapes and sizes.

Each individual electrode 19*a* has a similarity shape to the opening of the corresponding pressure chamber 16 as viewed in the stacking direction of the piezoelectric layers 17*a* and 17*b*. However, the shape is not limited to this design. For example, it may be so configured that the individual electrode 19*a* is not a similarity shape to the opening of the pressure chamber 16. As long as the individual electrode 19*a* has a size larger than the opening, alignment of the individual electrode 19*a* relative to the opening can be performed with a high precision and with ease, when the piezoelectric layer 17*a* or the piezoelectric layer 17*b* on which the internal electrode 19 is formed is contracted due to burning. Further, it may be so configured that each individual electrode 19*a* does not have a size larger than the opening of the pressure chamber 16.

In a case where the actuator unit 17 has one or more electrode other than the electrodes 18, 19, and 20. It may be preferable that all the electrodes including such electrode have smaller sizes, as a distance from the upper surface 12*x* of the channel unit 12 is larger in the stacking direction of the piezoelectric layers 17*a* and 17*b*. Alternatively, it may be so configured that the electrodes do not have such relationship of sizes.

It is not necessary that, in the actuator unit 17, an electrode closest to the upper surface 12*x* of the channel unit 12 (the common electrode 20 in the above-described embodiment) be a ground electrode. Further, if this electrode is formed on part of the surface, the electrode may have various shapes except for that in the third embodiment. For example, this electrode may be formed in the same pattern as the internal electrode 19. However, in terms of improvement in deformation efficiency of the individual active portion 19*x*1, it is preferable that connection active portions are not formed in this electrode, except for portions confronting the connection electrodes 19*b* of the internal electrode 19, like the third embodiment.

In the above-described embodiments, the thickness of the piezoelectric layer 17*a* is greater than the sum of the thickness of the piezoelectric layer 17*b* and the thickness of the vibration plate 17*c*. Because the thickness of the piezoelectric layer 17*a* is designed to be relatively large in this way, the deformation efficiency of the piezoelectric layer 17*a* can be improved. However, the thickness of each piezoelectric layer included in the actuator is not limited to this relationship, and may be modified appropriately. For example, the sum of the thickness of the piezoelectric layer 17*a* and the thickness of the piezoelectric layer 17*b* may be the same as the thickness of the vibration plate 17*c*, or may be greater than the thickness of the vibration plate 17*c*.

The piezoelectric layers 17*a* and 17*b* may be polarized in the opposite direction from each other along the stacking direction.

In the fourth embodiment, the group G of the individual electrodes 19*a* is provided for each subsidiary manifold channel 13*a*. However, the configuration is not limited to this. For example, one group G may be formed by one or a plurality of rows arranged in one direction, so that the individual electrodes 19*a* in the group G are electrically connected by connection electrodes.

The shape and arrangement of connection electrodes may be changed in various ways according to the shape, arrangement, and the like of individual electrodes.

Figure 8:
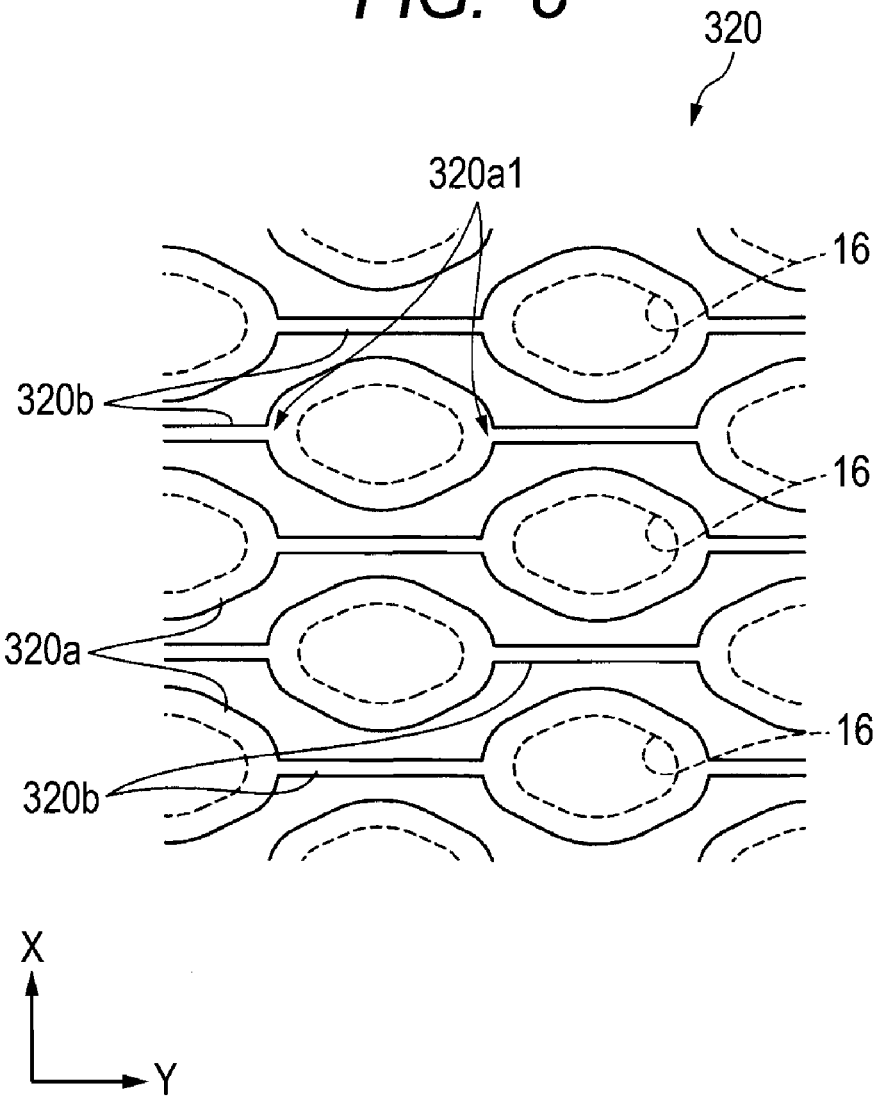
FIG. 8 is a plan view showing a common electrode in an inkjet head according to a third embodiment of the invention.

For example, according to a modification, an internal electrode is formed in a pattern similar to the common electrode 320 in FIG. 8, in the head 10 of the first embodiment. In this case, however, each connection electrode extends in a direction parallel to the lengthwise direction of the individual electrode, not directions intersecting the lengthwise direction, and also the length of each connection electrode is longer than that in the first embodiment (see FIG. 6C). Here, the land for the internal electrode may be arranged at substantially the center of the opposing parallel sides of a trapezoidal shape, or may be arranged at substantially the center of each side of the trapezoidal shape. Further, the common electrode may be formed over the entirety of the upper surface of the vibration plate 17*c*, or may be formed so that the individual portions 320*a* are connected in the main scanning direction X by linear-shaped connection portions. In the latter case, because the overlapping area is small between the connection electrodes and the connection portions in a plan view, deformation efficiency of the internal active portion 19*x* can be maintained at a high level, and an influence of crosstalk can be suppressed.

In another modification, an internal electrode is formed in a pattern similar to the common electrode 320 in FIG. 8 in the head 10 of the first embodiment, and a common electrode is formed in a pattern similar to the internal electrode 19 in FIG. 6C. In this modification, too, as in the third embodiment, portions of the piezoelectric layer 17*b* at which the connection electrodes are formed become non-active portions. Thus, an effect similar to that of the third embodiment (an effect that worsening of deformation efficiency of the individual active portion 19$x$1 can be suppressed more reliably) can be obtained.

Directions in which the connection electrodes extend from lengthwise ends of the individual electrodes are not limited to specific directions. The number of connection electrodes extending from lengthwise ends of one individual electrode is not limited to a specific number.

In the above-described embodiments, it is sufficient that the internal electrode is formed on either one of the lower surface of the piezoelectric layer 17*a* and the upper surface of the piezoelectric layer 17*b*, and that the common electrode is formed on either one of the lower surface of the piezoelectric layer 17*b* and the upper surface of the vibration plate 17*c*.

The deformation mode of the actuator is not to limited to the unimorph type, and may be other deformation modes such as a monomorph type, bimorph type, multimorph type, and a modified type of the monomorph type etc.

The shape of the opening of each pressure chamber 16 is not limited to a diamond shape. The shape may be another shape such as an elliptic shape, as long as the shape is elongated in one direction (that is, the shape is longer in one direction than in another direction).

The openings of the pressure chambers 16, the independent electrodes 18, and the individual electrodes 19*a* may by arranged in a single row/column, not in a matrix configuration.

The second piezoelectric layer (piezoelectric layer for flushing) may be also used for ejection for recording, not only for flushing.

The first piezoelectric layer (piezoelectric layer for recording) may be arranged to correspond to each opening, without straddling the openings of a plurality of pressure chambers 16.

It is not necessary that the first piezoelectric layer (piezoelectric layer for recording) be the outermost layer. For example, the piezoelectric layers 17*a* and 17*b* of the above-described embodiments may be switched upside down, so that the piezoelectric layer 17*a* for recording is on the lower side, and the piezoelectric layer 17*b* for flushing is on the upper side. In this case, the arrangement of the electrodes 18, 19, and 20 in the stacking direction may be changed appropriately.

The invention can be applied to a droplet ejecting head of both the line type and the serial type. Further, it is not limited to a printer, but can be applied to a facsimile apparatus, a copier, and the like. Further, a droplet ejecting head of the invention can also be applied to a head that ejects droplets other than ink droplets.

Hereinafter, the deformation amount of an active portion of a piezoelectric layer will be described in greater detail while referring to FIG. 10.

Figure 10:
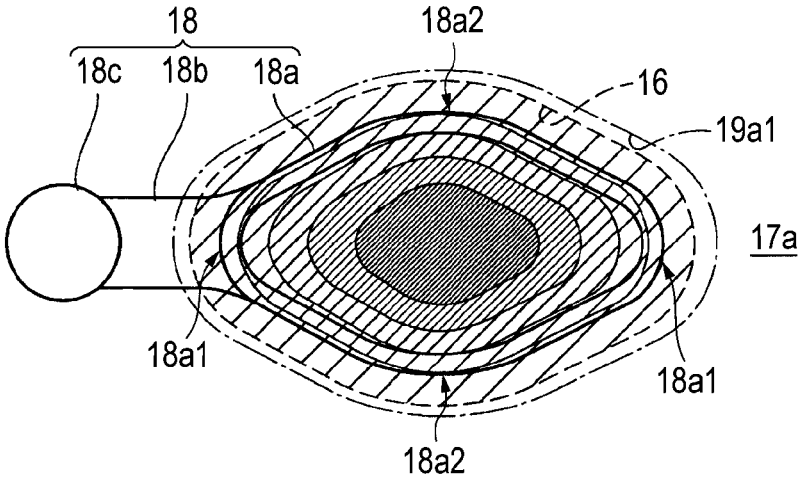
FIG. 10 is an analytical diagram showing an amount of displacement in an outermost piezoelectric layer during application of voltage as an example.

FIG. 10 shows the amount of deformation of a portion of the piezoelectric layer 17*a* at the time when voltage is applied, the portion being in confrontation with the pressure chamber 16. The amount of deformation is larger as intervals of the hatched lines are narrower. It is imagined that, if intensity of applied electric field is the same, the amount of deformation of the active portion will also be the same. From FIG. 10, however, it can be seen that the amount of deformation of the portion of the piezoelectric layer 17*a* during application of voltage is the largest in the center of the main electrode region 18*a*, and tends to be smaller toward the outer periphery of the main electrode region 18*a*. On the outer periphery, the amount of deformation is larger at widthwise ends 18*a*2 than at lengthwise ends 18*a*1 of the main electrode region 18*a*. Hence, it can be said that the widthwise ends 18*a*2 are more susceptible to displacement from outside of the pressure chamber 16.

Although FIG. 10 shows the amount of deformation of an active portion (independent active portion 18$x$) of the piezoelectric layer 17*a*, it is inferred that a similar tendency exists in the piezoelectric layer 17*b*. That is, the amount of deformation of the individual active portion 19$x$1 during application of voltage is the largest in the center of the individual electrode 19*a*, and tends to be smaller toward the outer periphery of the individual electrode 19*a*. It is also inferred that, on the outer periphery, the amount of deformation is larger at widthwise ends than at lengthwise ends 19*a*1 of the individual electrode 19*a*.

Thus, the inventor of the present application found out that, if the connection electrodes 19*b* are connected to widthwise ends (a portion of the individual active portion 19$x$1 at which the amount of deformation is relatively large during application of voltage) of the individual electrodes 19*a*, deformation of the individual active portion 19$x$1 is hindered when voltage is applied to the individual active portion 19$x$1, due to an influence of displacement of the portions of the piezoelectric layer 17*b* at which the connection electrodes 19*b* are formed.

What is claimed is:

1. A liquid ejecting head comprising:

a channel member formed with a liquid channel having a plurality of ejection ports for ejecting droplets and a plurality of pressure chambers in fluid communication with respective ones of the plurality of ejection ports, the channel member having a surface formed with a plurality of openings through which respective ones of the plurality of pressure chambers are exposed; and an actuator including a layered body disposed on the surface of the channel member so as to confront the plurality of openings for applying energy to liquid in the plurality of pressure chambers, the layered body including a first piezoelectric layer and a second piezoelectric layer both sandwiched between electrodes with respect to a stacking direction, wherein the first piezoelectric layer is formed thereon with a plurality of independent electrodes separated from one another and arranged at positions corresponding to respective ones of the plurality of openings, the first piezoelectric layer having a plurality of independent active portions at positions where the plurality of independent electrodes is located, the plurality of independent active portions being capable of displacing selectively;

wherein the second piezoelectric layer is formed thereon with a plurality of individual electrodes connected by connection electrodes and arranged at positions corresponding to the respective ones of the plurality of openings, the second piezoelectric layer having a plurality of individual active portions at positions where the plurality of individual electrodes is located, the plurality of individual active portions being incapable of displacing selectively;

wherein each of the plurality of openings has a shape that is longer in one direction parallel to the surface than in another direction intersecting the one direction and parallel to the surface;

wherein each of the plurality of individual electrodes has a shape that is longer in the one direction than in the another direction; and wherein the connection electrodes connect one-direction ends of the plurality of individual electrodes with one another, the one-direction ends being ends in the one direction.

2. The liquid ejecting head according to claim 1, wherein the first piezoelectric layer is the farthest away from the surface of the channel member among the piezoelectric layers included in the layered body; and wherein the plurality of independent electrodes is formed on a surface of the first piezoelectric layer on a side opposite the channel member.

3. The liquid ejecting head according to claim 1, wherein each of the plurality of independent electrodes has a similarity shape to and a size smaller than a corresponding one of the plurality of openings as viewed from the stacking direction.

4. The liquid ejecting head according to claim 1, wherein each of the plurality of individual electrodes has a size larger than a corresponding one of the plurality of openings as viewed from the stacking direction.

5. The liquid ejecting head according to claim 1, wherein each of the plurality of individual electrodes has a similarity shape to a corresponding one of the plurality of openings as viewed from the stacking direction.

6. The liquid ejecting head according to claim 1, wherein the actuator further comprises a vibration plate disposed between the layered body and the channel member to seal the plurality of openings.

7. The liquid ejecting head according to claim 1, wherein a plurality of electrodes arranged in the stacking direction to correspond to one of the plurality of openings has sizes that are smaller as a distance from the surface of the channel member is larger.

8. The liquid ejecting head according to claim 1, wherein each of the plurality of openings has a diamond shape of which a longer diagonal extends in the one direction.

9. The liquid ejecting head according to claim 1, wherein the connection electrodes extend in directions intersecting the one direction from the one-direction ends.

10. The liquid ejecting head according to claim 1, wherein two or more connection electrodes extend from each of the one-direction ends.

11. The liquid ejecting head according to claim 1, wherein an electrode closest to the surface of the channel member is a ground electrode.

12. The liquid ejecting head according to claim 11, wherein the first and second piezoelectric layers are polarized in the same direction along the stacking direction.

13. The liquid ejecting head according to claim 11, wherein the ground electrode extends over an entirety of a surface on which the ground electrode is formed.

14. The liquid ejecting head according to claim 1, wherein no electrode is provided at positions corresponding to the connection electrodes on an opposite surface, the opposite surface being a surface of the second piezoelectric layer opposite a surface on which the plurality of individual electrodes and the connection electrodes are formed.

15. The liquid ejecting head according to claim 1, wherein all of the plurality of individual electrodes formed on the second piezoelectric layer are connected by the connection electrodes.

16. The liquid ejecting head according to claim 1, wherein the plurality of openings is arranged on the surface of the channel member in a matrix configuration so as to form a plurality of rows each arranged in a row direction and a plurality of columns each arranged in a column direction;

wherein the plurality of individual electrodes forms a plurality of groups each including individual electrodes arranged in either one of the row direction and the column direction; and wherein the individual electrodes in each of the plurality of groups are connected by the connection electrodes.

17. The liquid ejecting head according to claim 16, wherein the liquid channel includes a plurality of common liquid chambers each being in fluid communication with a set of pressure chambers; and wherein each of the plurality of groups includes the individual electrodes corresponding to the set of pressure chambers.

* * * * *